US011378356B2

(12) United States Patent
Treto et al.

(10) Patent No.: US 11,378,356 B2
(45) Date of Patent: Jul. 5, 2022

(54) THIGH MOUNT

(71) Applicant: Tedder Industries, LLC, Post Falls, ID (US)

(72) Inventors: Timothy Treto, Mead, WA (US); Taylor Vold, Spokane Valley, WA (US); Drew Stephens, Coeur d'Alene, ID (US)

( * ) Notice: Subject to any disclaimer, the term of this patent is extended or adjusted under 35 U.S.C. 154(b) by 1 day.

(21) Appl. No.: 17/084,230

(22) Filed: Oct. 29, 2020

(65) Prior Publication Data

US 2021/0215456 A1 Jul. 15, 2021

Related U.S. Application Data

(60) Provisional application No. 62/959,379, filed on Jan. 10, 2020.

(51) Int. Cl.
*F41C 33/00* (2006.01)
*F41C 33/04* (2006.01)

(52) U.S. Cl.
CPC ..... *F41C 33/046* (2013.01); *F41C 33/041* (2013.01)

(58) Field of Classification Search
CPC .. F41C 33/041; F41C 33/0263; F41C 33/046; A45F 5/02; A45F 5/021; A45F 2200/0591
See application file for complete search history.

(56) References Cited

U.S. PATENT DOCUMENTS 6,149,042 A * 11/2000 Rassias ..... A45F 5/00 224/661
8,196,792 B2 * 6/2012 Clifton, Jr. ..... F41C 33/041 224/661
9,759,515 B2 * 9/2017 Yeates ..... F41C 33/0272
2012/0174341 A1 * 7/2012 Rogers ..... F41C 33/041 24/3.1
2020/0292273 A1 * 9/2020 Shearer ..... F41C 33/0263

* cited by examiner

*Primary Examiner* — Corey N Skurdal

(57) ABSTRACT

Representative implementations of devices and techniques provide a thigh mount assembly, to mount and to support an implement (such as a handgun, for example), an implement holster (such as a handgun holster or shell, for example), or the like, along with one or more accessories (duty pouches such as magazine carriers, a baton holder, a pepper spray canister, flashlight, or other carriers or accessories, for example) in a variety of configurations while worn on a person. Alternately, the thigh mount assembly may be used as a support for additional accessories (e.g., weapons, tools, instruments, supplies, etc.) as desired, such as accessories that are desired to be carried on the person. The assembly includes one or more removable or permanent attachment devices that may be used to temporarily or permanently attach the one or more accessories, as well as multiple attachment points that may also be used in like manner.

20 Claims, 7 Drawing Sheets

THIGH MOUNT

PRIORITY CLAIM AND CROSS-REFERENCE TO RELATED APPLICATION

This application claims the benefit under 35 U.S.C. § 119(e)(1) of U.S. Provisional Application No. 62/959,379, filed Jan. 10, 2020, which is hereby incorporated by reference in its entirety.

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. However, the holster should also be versatile enough to be comfortably carried by the user, such as when it is worn on the person of the user for an extended length of time. The holster should also be rigid and stable enough to allow the handgun to be repeatedly drawn and re-holstered, usually with the same hand.

At times it can be desirable to carry an implement such as a handgun in various locations on the user, for instance on a leg or thigh of the user. However, when doing so, it is desirable that the holster or holster mount provides versatility in accessing the handgun, as well as a high level of protection to the user and also to the handgun. It can also be desirable for the holster or holster mount to be securely attached to the user, particularly in military or law enforcement applications, or the like, such as where the user may be engaged in running, jumping, climbing, or other physical activities.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Introduction

Figure 1:
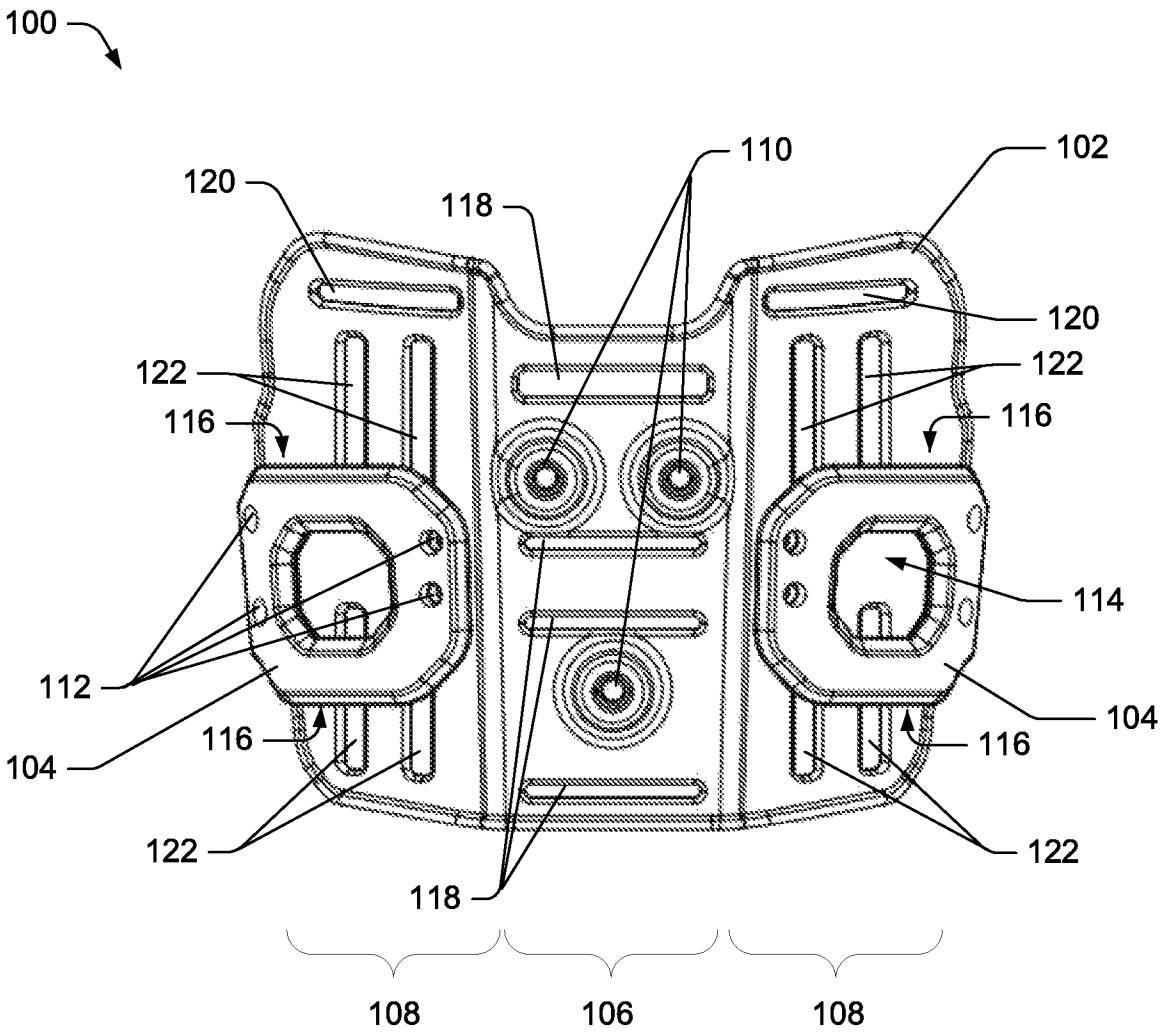
FIG. 1 shows a front view of an example main plate of an example thigh mount assembly, with pouch mounts attached, according to an embodiment.
Figure 3:
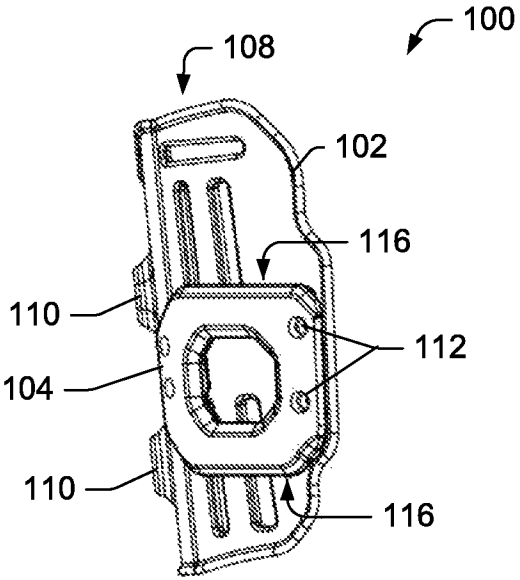
FIG. 3 shows a right side view of an example main plate of an example thigh mount assembly, with pouch mount attached, according to an embodiment.
Figure 2:
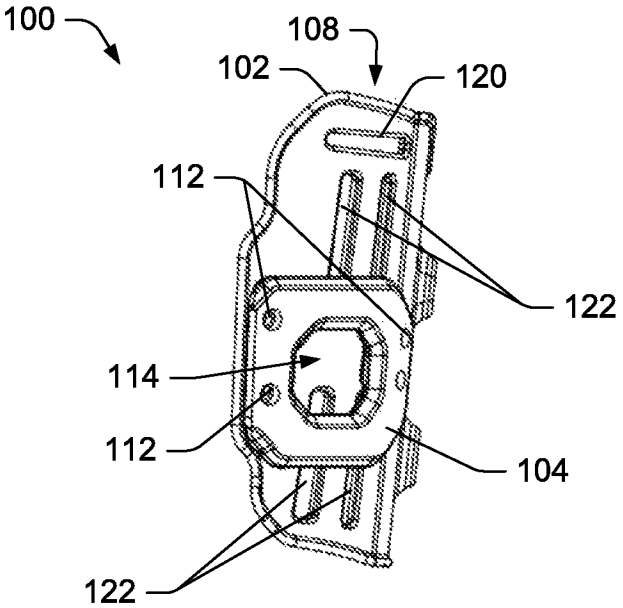
FIG. 2 shows a left side view of an example main plate of an example thigh mount assembly, with pouch mount attached, according to an embodiment.
Figure 4:
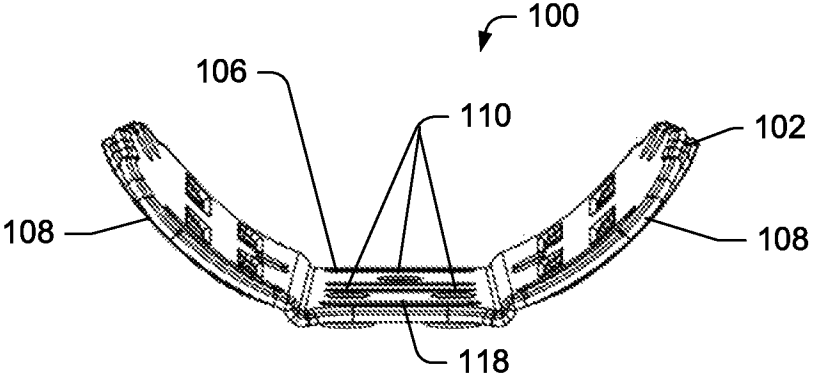
FIG. 4 shows a top view of an example main plate of an example thigh mount assembly, according to an embodiment.

Representative implementations of devices and techniques provide a thigh mount assembly ("assembly"), to mount and to support an implement (such as a handgun, for example), an implement holster (such as a handgun holster or shell, for example), or the like, along with one or more accessories (duty pouches such as magazine carriers, a baton holder, a pepper spray canister, flashlight, or other carriers or accessories, for example) in a variety of configurations. Alternately, the thigh mount assembly may be used as a support for additional accessories (e.g., weapons, tools, instruments, supplies, etc.) as desired, such as accessories that are desired to be carried on the person of the user (or other convenient carry arrangements).

The assembly includes one or more removable or permanent attachment devices ("pouch mounts") that may be used to temporarily or permanently attach the one or more accessories, as well as multiple attachment points that may also be used in like manner. The implement, implement holster, and accessories are intended to be removable from the thigh mount assembly when desired by the user, but are intended to remain securely attached to the thigh mount assembly until intentionally removed.

The assembly is arranged to be worn on a user's person, such as on the user's upper leg (for example) for temporarily and safely carrying the implement and accessories, while making the implement and accessories easily accessible to the user. In various examples, the assembly can be coupled to the user's clothing or gear for securing the assembly to the user in a desired configuration. In alternate embodiments, the assembly can also be worn on another part of a user's person, or it can be used to support an implement or implement holster in another location, not on a user.

Techniques and devices are discussed with reference to example handgun holsters, magazines, and accessories illustrated in the figures. However, this is not intended to be limiting, and is for ease of discussion and illustrative convenience. The assembly is designed and constructed to accommodate a multitude of support applications. For instance, the techniques and devices discussed may be applied to any of various implements, weapons, tools, instruments, supplies, cases, case designs, canisters, combinations, and the like, and remain within the scope of the disclosure.

Implementations are explained in more detail below using a plurality of examples. Although various implementations and examples are discussed here and below, further implementations and examples may be possible by combining the features and elements of individual implementations and examples.

Example Thigh Mount Assembly

An example thigh mount assembly ("assembly") 100, as detailed in FIGS. 1-17, is disclosed herein and described in several non-limiting example configurations. In various embodiments, an assembly 100 includes a main plate 102 and one or more pouch mounts 104. In some embodiments, an assembly 100 also includes means of attaching the main plate 102 to the user, such as one or more upper leg straps 702 and one or more lower leg straps 704. In other embodiments, other attachment means may be used to hold the main plate 102 in a desired location. In alternate embodiments, the assembly 100 may include additional or alternate components or features Referring to FIGS. 1-4, several views of an example thigh mount main plate 102, with pouch mounts 104 attached to the main plate 102, are shown. Pouch mounts 104 are optionally and removably attached to the main plate 102 to add versatility to the main plate 102, for example, to provide fixtures for mounting accessories and the like (such as magazine holders, for instance) to the main plate 102.

As shown in FIGS. 1-4, the main plate 102 comprises a rigid curved plate, where the curvature of the plate 102 is intended to conform to the general shape of a user's upper leg (or thigh). For instance, the overall shape of the main plate 102 may resemble a portion of the side of a cylinder. Alternately, to effect the curvature, the shape of the main plate 102 may resemble a portion of a side of a many-sided prism.

For example, the main plate 102 may include a center section 106 or like panel and two side sections 108 or like panels, on either side of the center section 106, as shown in FIGS. 1-4. One or more of the center section 106 and the two side sections 108 may be a substantially planar section or may be a curved plate section. The side sections 108 can extend from the center section 106 at an angle or in a curved manner. In alternate embodiments, the main plate 102 may be comprised of more than three sections. For example, the overall curved shape of the main plate 102 may be comprised of four or more roughly-planar sections or slightly curved sections joined at an angle or in a curved manner.

When worn on the outside of the user's thigh (see FIGS. 10 and 11), the curved shape of the main plate 102 wraps around a portion of the user's thigh. As explained above, the main plate 102 can also be worn in another location on the user's person, or attached to a location not on the user.

The main plate 102 of the thigh mount assembly 100 provides a rigid surface to attach one or more objects, including substantially heavy objects. For instance, the main plate 102 provides an attachment base for a handgun holster or other implement or implement holster, as well as for one or more duty pouches or other accessories (which can be attached to the main plate 102 directly, or attached to the main plate 102 using a pouch mount 104).

The main plate 102 and the pouch mounts 104 may be comprised of injection molded polymers, such as Nylon and the like. Three-dimensional printing may also be used to form the main plate 102 and/or the pouch mounts 104 using a suitable polymer, or polymer/fiber composite. A single layer or multiple layers of materials may be used to form the main plate 102. Alternate materials (which may be used alone or in combination with polymers and/or each other) may include fiberglass, carbon fiber, other composites, metals, alloys, and so forth. Materials and thickness of components may be selected for desired strength combined with light weight. In some embodiments, the main plate 102 is comprised of laminated layers of different materials, which may include combinations of any of the materials listed above. In other embodiments, a portion (such as the center section 106 or one or both side sections 108) may be comprised of multiple laminated layers.

Referring to FIGS. 1-4, in various embodiments, the main plate 102 includes holster mounting attachment points 110, such as the holster mounting holes 110 as shown in the figures. The attachment points 110, which may be reinforced for strength, can be used to attach an implement holster (such as a handgun holster, shell, or the like), holster backer, or other carrier, sheath, case, etc., to the main plate 102. Further, an adapter (for instance, a quick release adapter) that can be coupled to the implement, the holster or shell, backer, or the like may be coupled to the main plate 102 at the attachment points 110.

The holster mounting attachment points 110 may be located at the center section 106 of the main plate 102, as shown in FIGS. 1-4. Alternately, holster mounting points 110 may be located on one or both of the side sections 108, either instead of or in addition to the center section 106.

In various embodiments, the holster attachment points 110 may be sized and spaced to accommodate a specific implement holster or adapter, or they may be generally disposed to accept a number of holsters, backers, adapters, cases, etc. Holster mounting holes 110 may be tapped/threaded to receive screws or bolts or they may not be threaded so as to accommodate a variety of fasteners. In an alternate embodiment, attachment points 110 may include attachment connectors or hardware for coupling generic or a specific holster, backer, or adapter.

Figure 6:
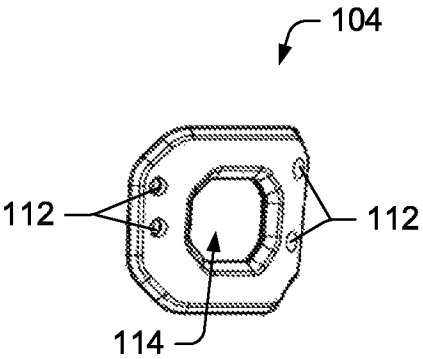
FIG. 6 shows a front view of an example pouch mount, according to an embodiment.
Figure 5:
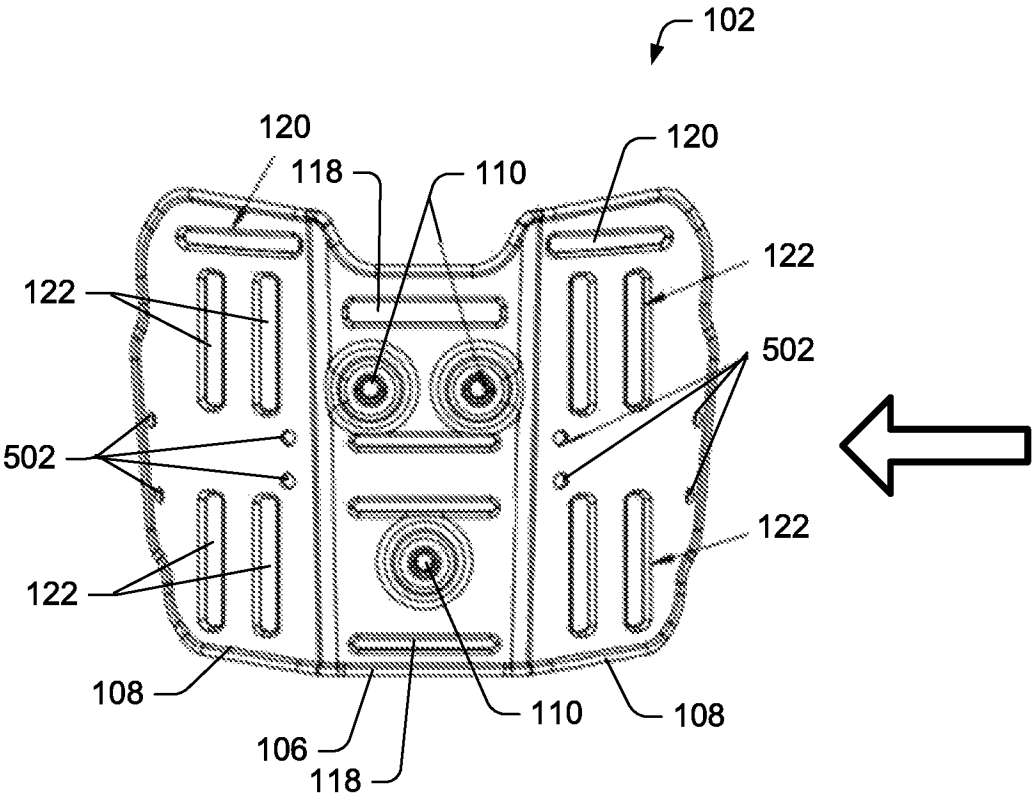
FIG. 5 shows a front view of an example main plate without pouch mounts attached, according to an embodiment.

FIG. 5 shows the main plate 102 without any pouch mounts 104 attached. FIG. 6 shows a pouch mount 104 in an orientation ready to be mounted to the main plate 102. As shown in FIG. 6, a pouch mount 104 may include one or more mounting holes 112 to attach the pouch mount 104 to the main plate 102. The mounting holes 112 may be arranged at either side of the pouch mount 104, so as to not obstruct the top and bottom areas of the pouch mount 104. Alternately, the mounting holes 112 may have a different arrangement relative to the pouch mount 104. In some embodiments, the mounting holes 112 are arranged at the perimeter of the pouch mount 104.

As shown at FIG. 5, the main plate 102 includes pouch mount holes 502 that are sized and located to attach at least one pouch mount 104. For instance, the pouch mount holes 502 may be arranged in like manner to the mounting holes 112 on the pouch mount 104.

In an implementation, as shown at FIG. 5, the main plate 102 includes mounting holes 502 configured to attach 2 or more pouch mounts 104 to the main plate 102. The pouch mounts 104 may be mounted to the side sections 108 of the main plate 102, or alternately, a pouch mount 104 may be mounted to the center section 106. In one embodiment, the main plate 102 may not include holster mounting holes 110, and may include pouch mount holes 502 at the side sections 108 and the center section 106.

As illustrated, pouch mounts 104 are attached to the main plate 102 via the associated pouch mount holes 502 in the main plate 102 and the mounting holes 112 of the pouch mounts 104. A pouch mount 104 may be removably attached to the main plate 102 using screws or other removable fasteners, tabs in slots, tongue in groove, snaps, and so forth. Alternately, a pouch mount 104 may be permanently attached to the main plate 102 using screws, bolts, adhesives, or any other combination of fasteners. In an embodiment, a pouch mount 104 may be integral to the main plate 102 (e.g., formed as part of the main plate 102).

A pouch mount 104 is a rigid or semi-flexible plate-like component, where the rigidity is based in part on the material and the thickness of the pouch mount 104. As shown at FIGS. 1-4 and 6, the pouch mounts 104 may either be substantially planar or have an arcuate contour. For example, in some embodiments, the overall contour of the pouch mount 104 may be similar to a portion of the side of a cylinder, a many-sided prism, or the like. As shown in the figures, a pouch mount 104 may have an opening or space 114 in the interior region of the pouch mount 104. The opening 114 may have a polygonal shape, ellipsoid shape, or other shape. The presence of the opening 114 may give the pouch mount 104 an overall ring-like or polygonal ring-like form.

As shown at FIG. 6, the pouch mount mounting holes 112 extend from the back of the pouch mount 104, partly or fully through the pouch mount 104. The mounting holes 112 are configured to attach the pouch mount 104 to the main plate 102, so the arrangement of at least some of the mounting holes 112 of the pouch mount 104 match the arrangement of the pouch mount holes 502 on the main plate 102. When the corresponding holes (112 and 502) are aligned, various hardware fasteners (e.g., bolts, screws, etc.) may be used to temporarily fasten the pouch mount 104 to the main plate 102. In an example, the pouch mount holes 502 at the main plate 102 and/or the pouch mount 104 may be threaded to accept screws or bolts, or the like.

In alternate embodiments, techniques may be used in combination to attach the pouch mounts 104 to the main plate 102. For example, the pouch mounts 104 and the main plate 102 may include complementary tabs and slots, tongue and grooves, or the like to allow the pouch mounts 104 to engage a portion of the main plate 102. The techniques may be used in combination with mounting holes (112 and 502) and fasteners or other techniques.

When the pouch mount 104 is attached to the main plate 102, there may be a gap 116 between the pouch mount 104 and the main plate 102 to accommodate a strap or other connecting component of the accessory to be mounted to the pouch mount 104. For instance, some accessories may include a belt loop, strap, clip, or other connecting component. The connecting component may be positioned behind the pouch mount 104 within the gap 116, while the pouch mount 104 is attached to the main plate 102. The accessory may be held to the main plate 102 and pouch mount 104 by the connecting component in that way.

In various embodiments, the gap 116 may be formed from the shape of the pouch mount 104 and/or the main plate 102. For instance, the structure of the pouch mount 104 may include an extension on the back side, at least at the locations of the mounting holes 112. Such an extended portion of the pouch mount 104 can result in a gap 116 at other locations around the perimeter of the back side of the pouch mount 104.

In some examples, the curved overall shape of the pouch mount 104 forms the gap 116, since only some portions (e.g., at the sides) of the pouch mount 104 may make contact with the main plate 102 when the pouch mount 104 is attached, due to the curvature.

In other embodiments, the gap 116 is present due to the pouch mount 104 being recessed at the back of the pouch mount 104. For example, the back of the pouch mount 104 may be recessed in a top-to-bottom arrangement, forming the gap 116. Alternately, the back of the pouch mount 104 may be recessed in a side-to-side arrangement, or other arrangement to form the gap 116.

In some embodiments, a pouch mount 104 is disconnected from the main plate 102, either partially or fully, to attach an accessory to the pouch mount 104 and main plate 102. In one example, one side of the pouch mount 104 may be disconnected from the main plate 102 with the fasteners loosened or removed. The connecting component of the accessory can be positioned behind the pouch mount 104 (e.g., a belt loop may be positioned around the pouch mount 104, a strap or clip may be positioned behind the pouch mount 104, etc.), and the one side of the pouch mount 104 is reattached to the main plate 102. In other embodiments, the connecting component (e.g., a clip or similar component) may be attached to the pouch mount 104 (for instance, using the gap 116) without disconnecting the pouch mount 104 from the main plate 102.

The accessories are securely attached to the pouch mounts 104 and the main plate 102, while remaining removable when desired by the user. To remove an accessory, the one side of the pouch mount 104 may be disconnected from the main plate 102 with the fasteners loosened or removed. The connecting component of the accessory can be removed from behind the pouch mount 104 (e.g., a belt loop may be removed from around the pouch mount 104, a strap or clip may be removed from behind the pouch mount 104, etc.), and the one side of the pouch mount 104 can be reattached to the main plate 102. In other embodiments, the connecting component (e.g., a clip or similar component) may be removed from the pouch mount 104 (for instance, using the gap 116) without disconnecting the pouch mount 104 from the main plate 102.

In an alternate embodiment, the opening 114 in the interior of the pouch mount 104 may be used to couple an accessory to the pouch mount 104. For example, the accessory may have a connecting component shaped to insert into the opening 114 when aligned at a predetermined rotational angle. Once inserted, the accessory may be rotated to lock the accessory to the pouch mount 104. The opening 114 may also be used in other ways to secure an accessory to the pouch mount 104 or the main plate 102. In other alternative embodiments, other techniques may be used to attach an accessory to the main plate 102 via the pouch mount 104.

Referring to FIG. 1, the main plate 102 may include one or more openings 118 (e.g., holes, slots, vents, etc.) disposed at the center section 106 or the side sections 108 of the main plate 102, passing through the main plate 102. The one or more openings 118 can provide ventilation to the user through the main plate 102, for example. Additionally, the one or more openings 118 can provide attachment points for items desired to be attached to the main plate 102. Clips, straps, belts, and other attachment devices may be inserted into or through the openings 118 to fix items to the main plate 102.

As shown at FIGS. 1-5, the main plate 102 can also include one or more sets of upper strap openings 120 and one or more sets of lower strap openings 122. The strap openings 120, 122 may comprise oblong slots, holes, or the like, configured to receive upper 702 and lower 704 straps. In alternate embodiments, the upper 120 or lower 122 strap openings may include strap connectors or the like, rather than strictly openings or holes. Further, the openings of the upper 120 or lower 122 strap openings may include gripping features, such as teeth or ridges, or a gasket to help hold the straps in place. In other embodiments, the main plate 102 may only include upper 120 or lower 122 strap openings, rather than both, or the arrangement or orientation of the upper 120 and/or lower 122 strap openings may be different than shown in the drawings.

Figure 9:
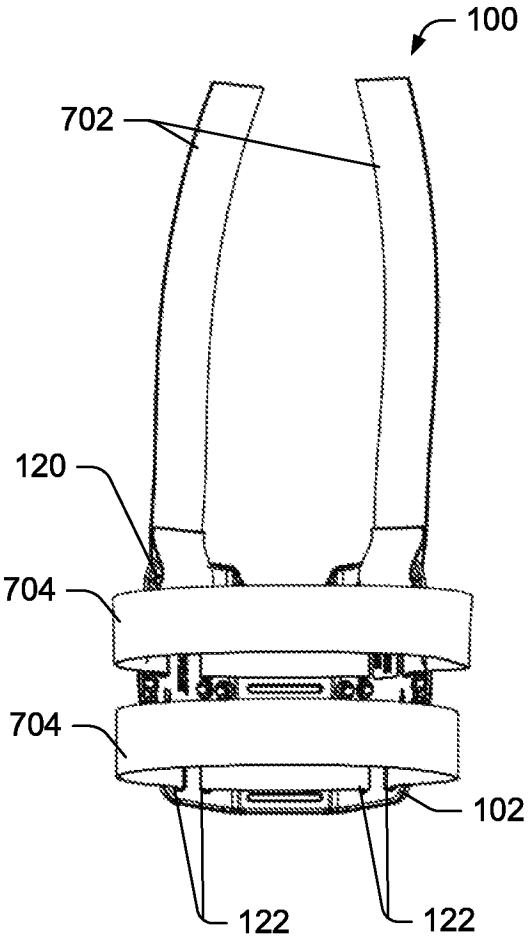
FIGS. 7-9 show front, side, and back views, respectively of an example thigh mount assembly without pouch mounts attached, according to an embodiment.
Figure 8:
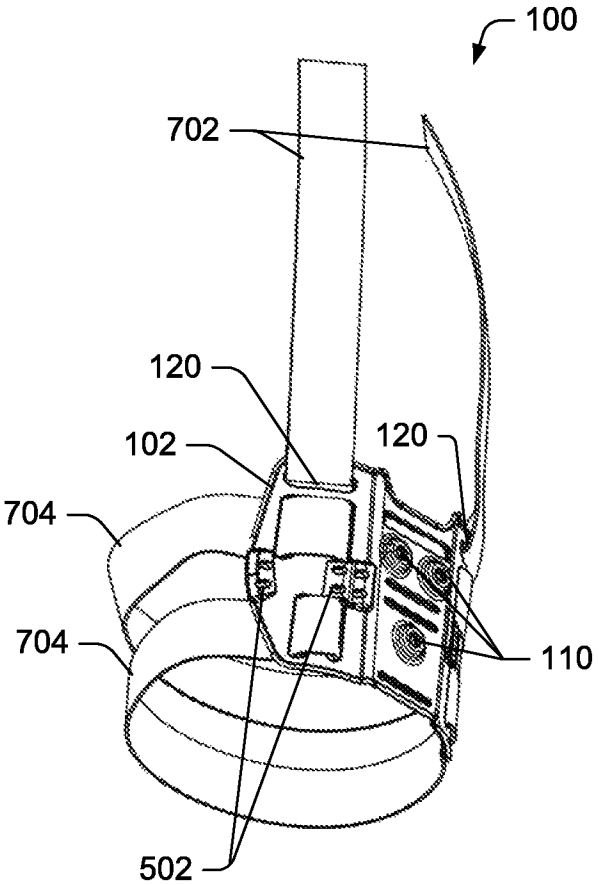
Figure 7:
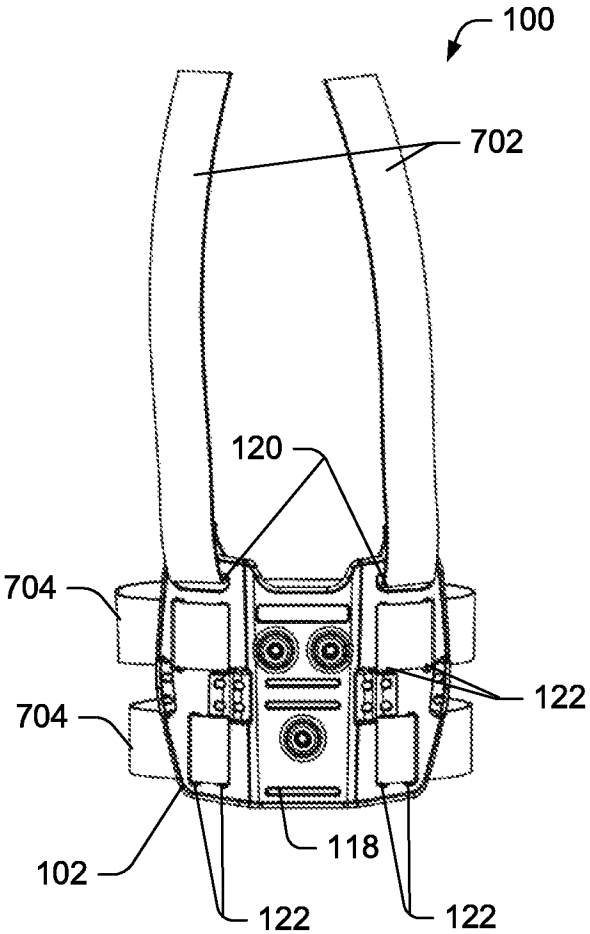

As shown at FIGS. 7-9, upper straps 702 may be threaded into the upper strap openings 120 and one or more lower straps 704 may be threaded into one or more of the lower strap openings 122. In various embodiments, the upper straps 702 may comprise a single strap or two separate straps. Further, the lower straps 704 may comprise a single strap or two or more separate straps.

FIGS. 7-9 give three views of an example arrangement, showing how straps 702 and 704 may be threaded into strap openings 120 and 122, respectively, of the main plate 102, according to an embodiment. For example, the multiple openings 122 allow the strap(s) 704 to weave in and out, through the main plate 102. In other embodiments, the straps 702, 704 may be threaded in a different arrangement as desired. Further, upper 702 and/or lower 704 straps may include one or more strap connectors (not shown) arranged to couple the straps 702, 704 to the main plate 102 or to couple straps 702, 704 to themselves or to other straps 702, 704.

In various implementations, the straps 702, 704 and/or main plate 102 may include additional or alternate components for coupling the straps 702, 704 to the main plate 102 (e.g., clamps, clips, buckles, snaps, hooks, loops, etc.).

Figure 11:
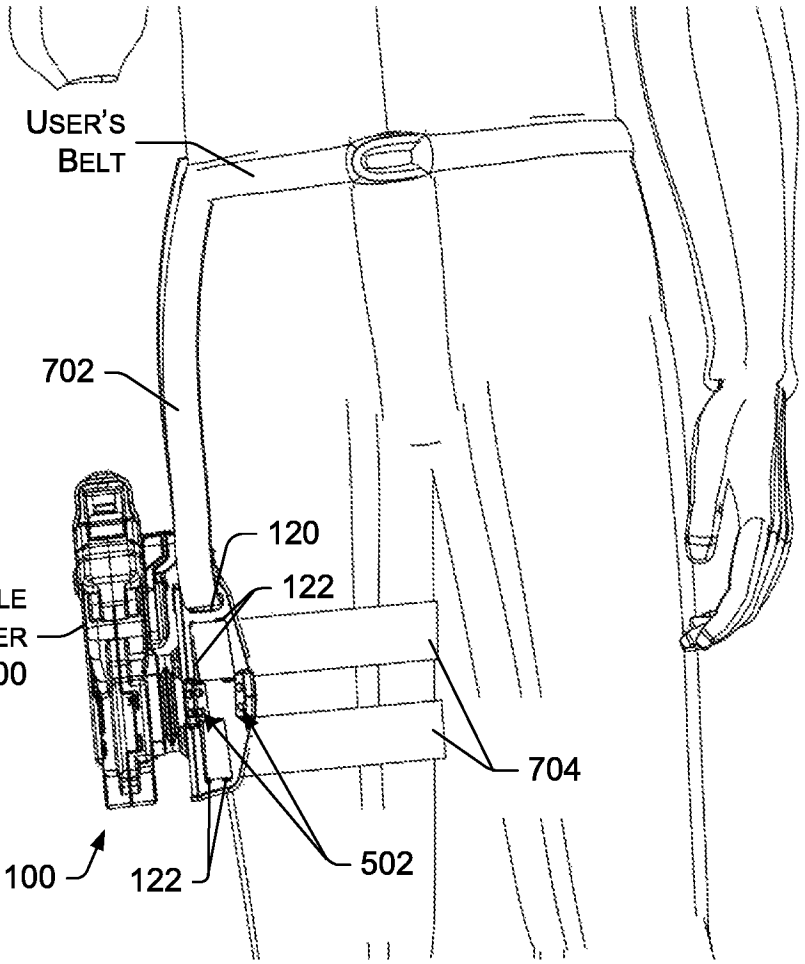
FIGS. 10 and 11 show views of an example thigh mount assembly with an example holster attached, in an example wear position on a user, according to an embodiment.
Figure 10:
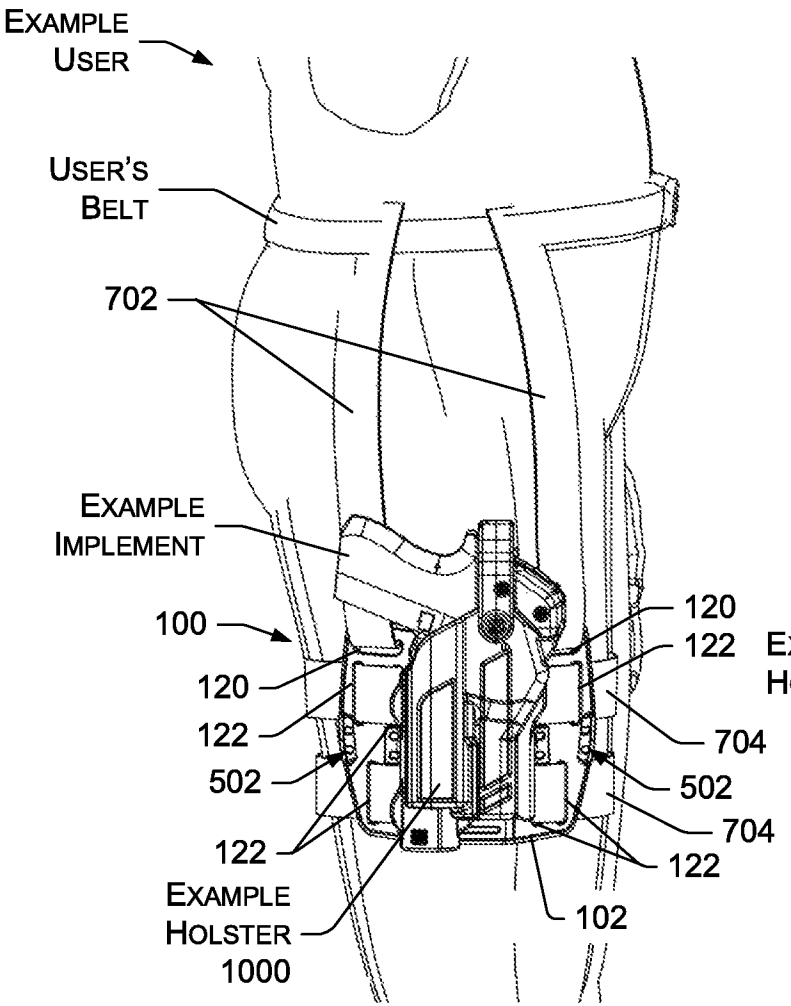

FIGS. 10-11 show two views of an example arrangement for wearing the thigh mount assembly 100 on a user's person, according to one embodiment. The illustrations of FIGS. 10-11 also show an example holster 1000 with an example implement (e.g., handgun) coupled to the main plate 102 of the thigh mount assembly 100. In an implementation, the assembly 100 includes an implement holster 1000, such as the example implement holster 1000 shown in FIGS. 10-11, or another type of holster. In other words, the thigh mount assembly 100 also may include an implement holster 1000 permanently or removably attached to the main plate 102. The implement holster 1000 may be coupled to the main plate 102 directly, using the attachment holes 110, or may be coupled to the main plate 102 via an adapter, or the like, which is coupled to the main plate 102 using one or more of the attachment holes 110.

No pouch mounts 104 are shown attached to the main plate 102 in the views of FIG. 10 and FIG. 11. The threading of the straps 702, 704 through the strap openings 120, 122 can be clearly seen in this arrangement. However, example pouch mounting holes 502 are shown. In an implementation, an arrangement with no pouch mounts 104 on the main plate 102 comprises one example useful application of the assembly 100.

In the example arrangement of FIGS. 10-11, one or more lower straps 704 are wrapped around the upper leg of the user and threaded through the lower strap openings 122 of the main plate 102 to secure the main plate 102 to the thigh of the user. In an embodiment, two lower straps 704 are wrapped around the upper leg of the user and threaded through two sets of lower strap openings 122 in the main plate 102. In an alternate embodiment, a single strap 704 may be wrapped around the upper leg of the user and threaded through a single set of lower strap openings 122 or threaded through two (or more) sets of lower strap openings 122 in the main plate 102. In some cases, strap couplers (not shown, e.g., hook and loop materials, clips, snaps, etc.) may be used to secure the straps 704 in place. Alternately, a lower strap 704 may comprise a single loop of material.

The upper straps 702 are threaded through the upper strap openings 120 of the main plate 102, and are secured to the user's belt or other item of clothing or gear to hold the main plate 102 in a desired position. The upper straps 702 may include loops at the bottom end, or include other connection components for securing the upper straps 702 to the main plate 102. The upper straps 702 may also include loops at the top end, or include other connection components for securing the upper straps 702 to the user's clothing or gear. The thigh mount assembly 100 may be worn on either leg, and the example holster may be mounted in either a left or right-handed orientation on the main plate 102.

In various embodiments, flexible components of the assembly 100, including the straps 702 and/or 704 may be comprised of flexible polymers, TPEs, aramids, ballistic materials, natural or synthetic leathers, other textiles, or the like. In some embodiments, the straps 702 and/or 704 may be comprised of a single layer or multiple layers of materials. The multiple layers may be selected to provide various desired characteristics for the straps 702, 704, such as strength, comfort, resilience, utility, weight, and so forth. In many examples, all layers may contribute to desired light weight, strength, and resilience. In some implementations, the straps 702, 704 include one or more reinforcement layers comprising a metal, a metal alloy, a metallic composite, other composite(s), ballistic nylon, or the like.

In an implementation, a strap 702 and/or 704 includes an adjustment portion (not shown) coupled to one end of the strap 702, 704 to provide retention of the strap 702, 704 to the user. In the implementation, the adjustment portion can interface with a fastener of a closure portion at another end of the strap 702, 704. The adjustment portion and the closure portion temporarily couple together the ends of the strap 702, 704 when the strap 702, 704 is wrapped around the user. In one example, the adjustment portion comprises hook and loop fasteners, or the like. In the example, the adjustment portion may be inserted through an opening 120, 122, and looped back on itself or on the strap 702, 704, temporarily coupling the adjustment portion to the other end of the strap 702, 704.

Figure 13:
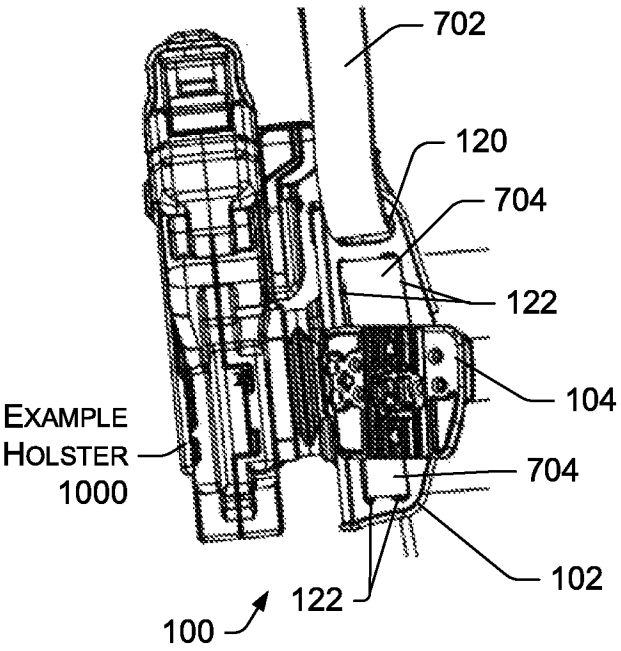
FIGS. 12 and 13 show front and side views of an example thigh mount assembly with a holster attached, with pouch mounts attached, according to an embodiment.
Figure 12:
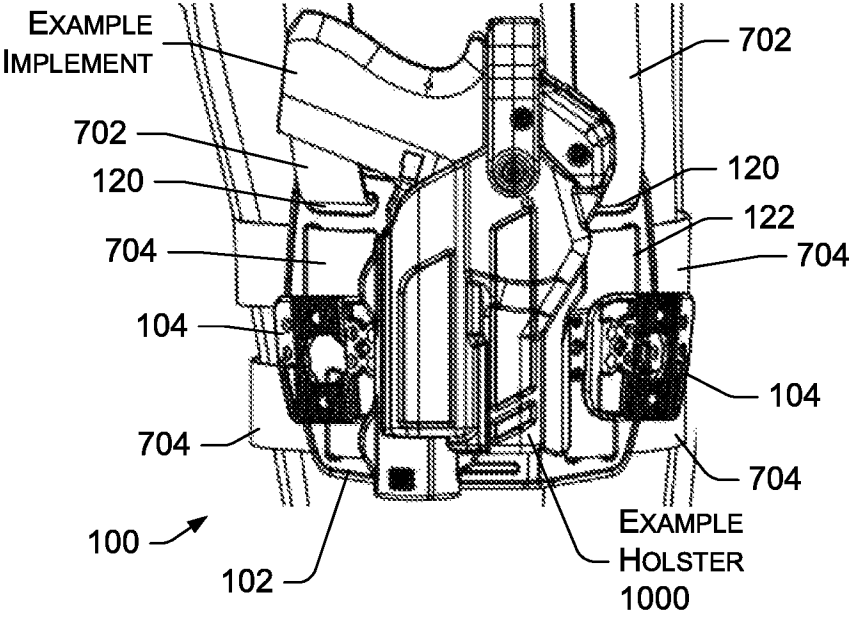

The illustrations of FIGS. 12-13 show the thigh mount assembly 100, as worn on an upper leg of a user, in another example configuration. The second configuration is shown in a front view at FIG. 12 and in a side view at FIG. 13. The illustrations include an example holster 1000 with an example implement attached to the main plate 102.

The second configuration at FIGS. 12 and 13 shows the thigh mount assembly 100 with pouch mounts 104 attached. A pouch mount 104 is shown attached to each of the side sections 108 of the main plate 102. Alternately, only one pouch mount 104 may be attached to the main plate 102. Pouch mounts 104 may be used in this configuration to removably attach one or more accessories to the assembly 100. The versatility of the pouch mount 104, including the opening 114, the gap 116, and the overall size, shape, and rigidity of each pouch mount 104 allows for a wide variety of accessories that may be attached using the pouch mount 104.

Figure 15:
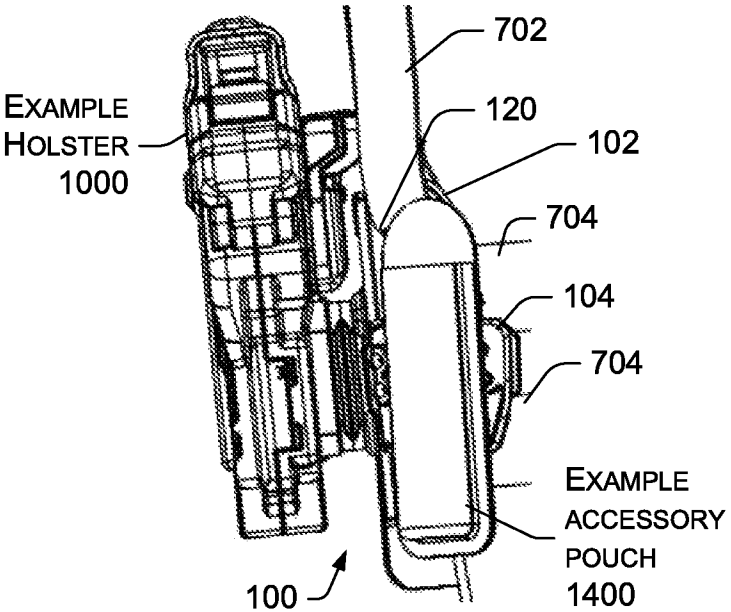
FIGS. 14 and 15 show front and side views of an example thigh mount assembly with a holster attached, with example duty pouches attached to pouch mounts, according to an embodiment.
Figure 14:
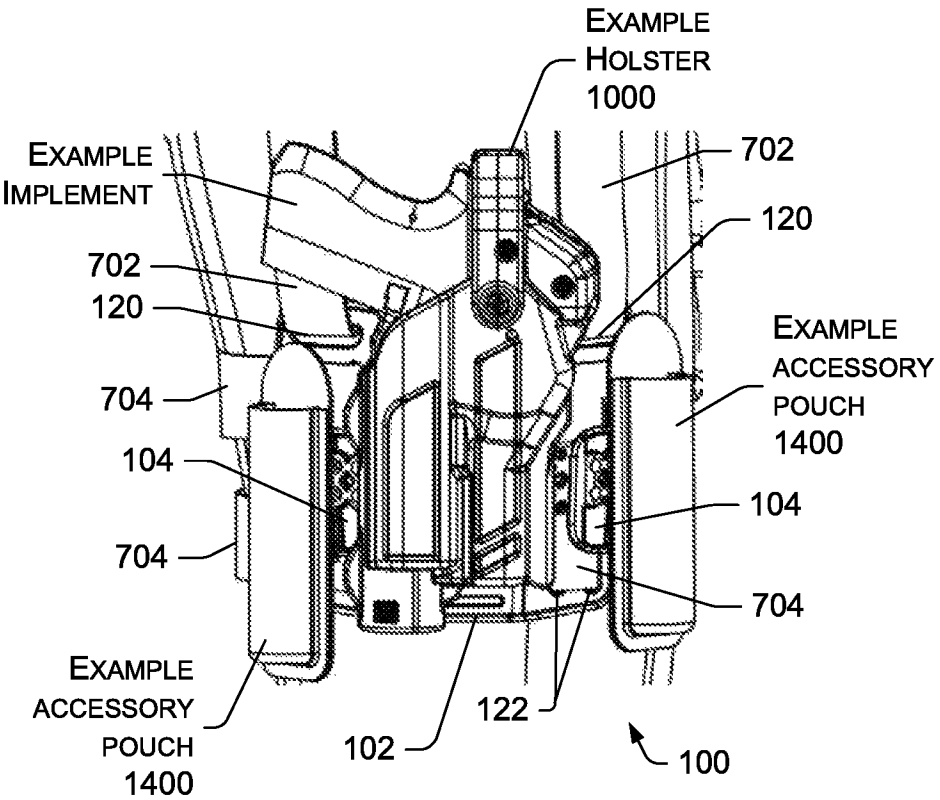

The illustrations of FIGS. 14-15 show the thigh mount assembly 100, as worn on an upper leg of a user, in a third example configuration. The third configuration is shown in a front view at FIG. 14 and in a side view at FIG. 15. The illustrations include an example holster 1000 with an example implement attached to the main plate 102.

The third configuration at FIGS. 14 and 15 shows the thigh mount assembly 100 with example accessories (e.g., duty pouches) coupled to each of the pouch mounts 104. For instance, duty pouches may include magazine carriers, a baton holder, a pepper spray canister, or other carriers or accessories. Other accessories that may be coupled to the pouch mounts 104 may include weapons, tools, instruments, supplies, first aid kits, transmitters, and so forth. In various arrangements, multiple accessories may be carried using the pouch mounts 104. Alternately, only one accessory may be attached to the main plate 102 using a pouch mount 104. Various alternate arrangements are also possible, with various combinations of pouch mounts 104 and accessories (or the holster) coupled to the main plate 102 or left off.

For example, in an implementation, the assembly 100 includes one or more accessory pouches 1400, such as the example accessory pouches 1400 shown in FIGS. 14-15, or another type of accessory pouch. In other words, the thigh mount assembly 100 also may include one or more accessory pouches 1400 permanently or removably attached to the main plate 102. The one or more accessory pouches 1400 may be coupled to the main plate 102 directly, using the attachment holes 502, or may be coupled to the main plate 102 via the pouch mounts 104.

Accessory pouches 1400 may be comprised of a textile material, such as a ballistic nylon, for example, or a polymer, a composite, a metal, an alloy, or combinations of these and/or other materials.

In various implementations, the thigh mount assembly 100 may include additional or alternate components, or have different shapes or sizes than those illustrated.

As discussed above, the techniques, components, and devices described herein with respect to the implementations are not limited to the illustrations of FIGS. 1-15. In some cases, additional or alternative components, techniques, sequences, or processes may be used to implement the techniques described herein. Further, the components and/or techniques may be arranged and/or combined in various combinations, while resulting in similar or approximately identical results.

It is to be understood that an assembly 100 may be implemented as a stand-alone device or as part of a system (e.g., integrated with other components). In various implementations, additional or alternative components may be used to accomplish the disclosed techniques and arrangements.

In the various example embodiments illustrated in FIGS. 1-15, the location and position of the components and features are for example. Other locations and positions are contemplated and are within the scope of this disclosure. In various implementations, the assembly 100 may include fewer, more, or alternate components, and remain within the scope of the disclosure.

Various implementations and examples are discussed herein, and further implementations and examples may be possible by combining the features and elements of individual implementations and examples.

Conclusion

While various discreet embodiments have been described throughout, the individual features of the various embodiments may be combined to form other embodiments not specifically described. The embodiments formed by combining the features of described embodiments are also within the scope of the disclosure.

What is claimed is:

1. A holster mounting assembly, comprising:

a main plate adapted to be coupled to a holster, the main plate comprising a rigid curved plate, the main plate including one or more holster mounting attachment points and one or more pouch mount attachment points; and one or more pouch mounts, comprising substantially planar or arcuate plates, arranged to be removably coupled to the main plate at the pouch mount attachment points.

2. The holster mounting assembly of claim 1, further comprising one or more upper straps and one or more lower straps coupled to the main plate.

3. The holster mounting assembly of claim 2, further comprising one or more upper strap openings disposed at the main plate and adapted to couple the one or more upper straps to the main plate and one or more lower strap openings disposed at the main plate and adapted to couple the one or more lower straps to the main plate.

4. The holster mounting assembly of claim 3, wherein the main plate includes multiple lower strap openings, and wherein the one or more lower straps are woven through the multiple lower strap openings.

5. The holster mounting assembly of claim 1, wherein the main plate includes a center panel having the one or more holster mounting attachment points and two side panels having the one or more pouch mount attachment points, the center panel and the two side panels forming an overall curved shape of the main plate.

6. The holster mounting assembly of claim 1, wherein the main plate is configured to be worn on an upper leg of a person, and wherein a curved shape of the main plate is adapted to substantially conform to an outer portion of the upper leg of a person.

7. The holster mounting assembly of claim 1, wherein at least one of the one or more holster mounting attachment points and the one or more pouch mount attachment points is threaded for use with a threaded fastener.

8. The holster mounting assembly of claim 1, wherein the main plate includes at least two sets of pouch mount attachment points, and wherein the assembly includes at least two pouch mounts removably coupled to the main plate at the at least two sets of pouch mount attachment points.

9. The holster mounting assembly of claim 1, wherein the one or more pouch mounts comprise fixtures for mounting accessories to the main plate.

10. A holster mounting assembly, comprising:

a main plate comprising an attachment base for a holster and for one or more accessories, the main plate comprising a rigid curved plate configured to be worn on an upper leg of a person, the main plate including one or more holster mounting attachment points, one or more leg strap attachment points, and one or more pouch mount attachment points;

one or more leg straps coupled to the main plate at the one or more leg strap attachment points and configured to secure the main plate to an upper leg of a person; and at least one pouch mount, comprising a substantially planar or arcuate plate removably coupled to the main plate via the one or more pouch mount attachment points.

11. The holster mounting assembly of claim 10, further comprising a gap between the at least one pouch mount and the main plate, the gap configured to allow a connecting component of an accessory to be inserted into the gap while coupled to the at least one pouch mount.

12. The holster mounting assembly of claim 10, further comprising an implement holster coupled to the main plate via the one or more holster mounting attachment points.

13. The holster mounting assembly of claim 10, further comprising at least one accessory pouch removably coupled to the at least one pouch mount.

14. The holster mounting assembly of claim 10, wherein the main plate includes a center panel and two side panels adjoining the center panel at an angle or curve relative to the center panel, the center panel and the two side panels forming an overall curved shape of the main plate.

15. The holster mounting assembly of claim 14, wherein the one or more holster mounting attachment points are disposed at the center panel and wherein one or more pouch mount attachment points are disposed at each of the two side panels.

16. The holster mounting assembly of claim 10, wherein the main plate includes at least two sets of pouch mount attachment points having a predetermined pattern, and wherein the assembly includes at least two pouch mounts having mounting points with the predetermined pattern, the at least two pouch mounts removably coupled to the main plate at the at least two sets of pouch mount attachment points.

17. The holster mounting assembly of claim 10, wherein the at least one pouch mount includes an opening at an interior region of the at least one pouch mount, the at least one pouch mount having a ring-like shape.

18. A holster assembly, comprising:

a main plate comprising an attachment base for a holster and for one or more accessories, the main plate comprising a rigid curved plate configured to be worn on an upper leg of a person, the main plate including one or more holster mounting attachment points, one or more leg strap attachment points, and one or more pouch mount attachment points;

an implement holster coupled to the main plate via the one or more holster mounting attachment points;

one or more leg straps coupled to the main plate at the one or more leg strap attachment points and configured to secure the main plate to an upper leg of a person; and at least one pouch mount comprising a fixture for mounting accessories to the main plate, the at least one pouch mount comprising a substantially planar or arcuate plate removably coupled to the main plate via the one or more pouch mount attachment points.

19. The holster mounting assembly of claim 18, further comprising a gap between the at least one pouch mount and the main plate, the gap configured to allow a connecting component of an accessory to be inserted into the gap while coupled to the at least one pouch mount.

20. The holster mounting assembly of claim 19, further comprising at least one accessory pouch removably coupled to the at least one pouch mount, a connecting component of the accessory pouch inserted into the gap to secure the accessory pouch to the pouch mount.

* * * * *